US007859192B2

(12) United States Patent
Mühlschlegel

(10) Patent No.: US 7,859,192 B2
(45) Date of Patent: Dec. 28, 2010

(54) METHOD FOR OPERATING HIGH-PRESSURE LAMPS WITHOUT HOTSTARTING AND LUMINAIRE HAVING TWO HIGH-PRESSURE DISCHARGE LAMPS

(75) Inventor: Joachim Mühlschlegel, Gröbenzell (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 327 days.

(21) Appl. No.: 11/990,114

(22) PCT Filed: Aug. 29, 2006

(86) PCT No.: PCT/EP2006/065789

§ 371 (c)(1),
(2), (4) Date: Feb. 7, 2008

(87) PCT Pub. No.: WO2007/025974

PCT Pub. Date: Mar. 8, 2007

(65) Prior Publication Data

US 2009/0295308 A1 Dec. 3, 2009

(30) Foreign Application Priority Data

Aug. 30, 2005 (DE) ..... 10 2005 041 075

(51) Int. Cl.
*H05B 41/00* (2006.01)

(52) U.S. Cl. ..... 315/121; 315/127

(58) Field of Classification Search ..... 315/86–90, 315/119, 121, 127, 312, 313, 322, 323, 360, 315/362

See application file for complete search history.

(56) References Cited

U.S. PATENT DOCUMENTS

| | | | | |
|---|---|---|---|---|
| 4,535,271 | A | 8/1985 | Holmes | |
| 4,700,110 | A * | 10/1987 | McNair et al. | 315/87 |
| 4,888,494 | A * | 12/1989 | McNair et al. | 307/38 |
| 5,111,114 | A | 5/1992 | Wang | |
| 5,677,601 | A | 10/1997 | Zuchtriegel | |
| 5,821,700 | A * | 10/1998 | Malvaso | 315/291 |
| 6,091,208 | A | 7/2000 | Flory, IV | |
| 6,731,080 | B2 * | 5/2004 | Flory | 315/312 |
| 2003/0080694 | A1 | 5/2003 | Collins | |

FOREIGN PATENT DOCUMENTS

| | | |
|---|---|---|
| GB | 2 360 150 A | 9/2001 |

* cited by examiner

*Primary Examiner*—Thuy Vinh Tran

(57) ABSTRACT

High-pressure discharge lamps can only be restarted in the hot state at a very high starting voltage. In order to avoid hotstarting, a method for operating high-pressure discharge lamps without hotstarting comprises two high-pressure discharge lamps (12*a*, 12*b*) being provided in one luminaire. The two high-pressure discharge lamps are driven as follows: When the luminaire is switched off, the first lamp is switched off, and the second lamp is set to be in a standby state for the period of time for the recovery of the first lamp or remains in such a state, in which it is not switched off. When the luminaire is switched on again during this period of time, the second lamp can assume the operating state again immediately without being started. If the luminaire is not switched on again, the second lamp is likewise switched off once the period of time has elapsed.

13 Claims, 3 Drawing Sheets

METHOD FOR OPERATING HIGH-PRESSURE LAMPS WITHOUT HOTSTARTING AND LUMINAIRE HAVING TWO HIGH-PRESSURE DISCHARGE LAMPS

TECHNICAL FIELD

The invention relates to a method for operating high-pressure lamps without hotstarting. It also relates to a luminaire or a pair of luminaires having two high-pressure discharge lamps in accordance with the precharacterizing clause of patent claim 10.

PRIOR ART

High-pressure lamps are started at starting voltages of from 2 kV to 4 kV peak. If they are switched off in the hot state after a specific period of time of their operation and are then intended to be switched on again, a substantially higher starting voltage of from 10 kV to 30 kV is required (hot restarting).

Not every electronic ballast and every luminaire is designed to provide this increased starting voltage. However, in the case of conventional electronic ballasts a waiting period of time of from 2 to 15 min is required once the high-pressure discharge lamp has been switched off until the lamp can be restarted at the conventional starting voltage of from 2 kV to 4 kV peak. As a result, it has not been possible until now to use the high-pressure lamp for many potential applications. The luminaires equipped for providing the increased starting voltage entail increased outlay and are substantially more complex in design terms. The electronic ballast or a starting unit in the lamp base or the lampholder generates the required high starting voltage of from 10 kV to 30 kV. Owing to the high starting voltage, special insulation is required in the lamp, on the connection wires and in the lampholder. Conventional lamps with a base at one end are not capable of being hot-started. As a result of the high starting voltage, problems occur in terms of safety when replacing a lamp, and severe radio interference occurs (problems with electromagnetic compatibility).

Generation of the high starting voltage results in considerable additional costs entailed with the electronic ballast. In addition to the increased starting voltage, an increased transfer voltage also needs to be provided by the electronic ballast during hot restarting, which likewise brings about additional costs for the electronic ballast.

DESCRIPTION OF THE INVENTION

The object of the present invention is to provide a method for operating high-pressure lamps which does not entail these additional costs and in which the problem of hotstarting can be circumvented. It should be possible for the high-pressure discharge lamps to be constructed in a manner which is as simple as possible without there being the problem of a wait of from 2 to 15 min for the recovery time of the lamp for renewed starting at the conventional starting voltage.

The invention provides a method as claimed in patent claim 1. In addition, according to the invention, a luminaire as claimed in the precharacterizing clause of patent claim 10 is developed by the characterizing features of patent claim 10.

The method according to the invention is therefore a method for operating high-pressure discharge lamps without hotstarting, in which two high-pressure discharge lamps are provided in one luminaire. When the luminaire is switched off, the first lamp is switched off and the second lamp is set to be in a standby state for the period of time for the recovery of the first lamp or remains in such a state, in which it is not switched off. As a result, when the luminaire is switched on again during this period of time, the second lamp can assume the operating state without being started. If the luminaire is not switched on again, the second lamp can likewise be switched off once the period of time for the recovery of the first lamp has elapsed.

The invention uses the fact that the brightness of lamps is perceived logarithmically. A single lamp is not perceived as being half as bright as two lamps, rather as being almost just as bright. A single lamp is only perceived as being half as bright if, in terms of luminous efficiency, it is 20 dB lower. A single lamp is, however, 3 dB lower than two lamps.

The invention uses this to provide a luminaire which has two high-pressure discharge lamps for illuminating an area. The luminaire is regarded as being switched on at least in a preliminary stage when one of the lamps is illuminated. The luminaire is considered to be switched off if only one of the lamps is switched off and the second is in the standby state.

In this case, the standby state can be defined as the lamp being operated normally. The user already perceives that the luminaire has responded to his switch-off operation when only one of the lamps is switched off.

However, the second lamp is preferably dimmed in the standby state such that it outputs less light and therefore, in the case of a lamp whose luminous efficiency has been dimmed to, for example, 50%, the entire luminaire outputs 75% less light in the switched-off state than in the switched-on state. The lamp may also be operated in pulsed fashion in the standby state such that it outputs flickering light. As a result, it is made clear to the user that the luminaire has actually introduced the switch-off operation.

As a result of the stepwise switching-off of the individual lamps of the luminaire, either the second lamp is still switched on to such an extent that it can assume the operating state again at any time without being restarted or the first lamp has already recovered and can be started at a conventional starting voltage of from 2 kV to 4 kV peak. In the former case of the luminaire being switched on during the period of time for the recovery of the first lamp, the second lamp can be operated at an increased power, with the result that it outputs more light, to be precise until the first lamp is started. It is therefore possible to compensate for absence of one lamp in the switched-on state.

In one preferred embodiment of the invention, once the second lamp has been switched off, a recovery phase begins for the second lamp. If, during this recovery phase for the second lamp, the luminaire is switched on again, only the first lamp is started and therefore switched on. Only once the period of time for the recovery of the second lamp has elapsed is the second lamp also started and therefore switched on. Once again, in this case, the luminaire is already regarded as being (preliminarily) switched on when only one of the two lamps of the luminaire is actually switched on. The second lamp then follows.

If the luminaire is switched on again only once the recovery phase for the first lamp has elapsed, the second lamp has been switched off and once the recovery phase for the second lamp has also elapsed, both lamps can be started simultaneously and therefore switched on when the luminaire is switched on. In the process, in each case one of the lamps is preferably boosted. Boosting means that the lamp has more power applied to it, with the result that the mercury which is typically provided in a high-pressure discharge lamp reaches the vapor phase more rapidly in this lamp, the plasma becomes hotter, and the full brightness is achieved earlier.

Since the lamps age more rapidly during boosting, alternating operation is preferably used when boosting (for this purpose, those reconnection operations which take place once the two recovery phases have elapsed are counted) such that both lamps are run up simultaneously. The first and the second lamps are then boosted alternately, for example the first lamp is boosted during reconnection operations having an odd number and the second lamp is boosted during reconnection operations having an even number.

It is also possible, in order to improve the distribution of aging phenomena in the lamps, for there to be alternate operation between the lamps when the luminaire is switched off, i.e. first of all the first lamp can initially be switched off and the second lamp can remain in the standby mode, or vice versa.

The luminaire according to the invention is a conventional luminaire having two high-pressure discharge lamps, as is known in the prior art, i.e. a luminaire having an electronic ballast, which may comprise, for example, a microprocessor, the luminaire being connected to a light switch, by means of which it is switched on and off.

The supply voltage of the electronic ballast is usually provided directly via the light switch. In addition to this direct provision of the supply voltage, an information line is provided according to the invention, which information line is used to transmit information on the switching state of the light switch to the electronic ballast (in particular the microprocessor). The information line can have the supply voltage directly applied to it, for example, with the result that logic one on the information line is defined such that the voltage is present, and logic zero is defined such that the voltage is not present. Reference is made to the fact that this information line is an additional line which has the name information line because it is used exclusively for transmitting information and not for transmitting power.

In one preferred embodiment, the electronic ballast is designed (i.e. for example its microprocessor is programmed) to determine the number of switch-on operations of the luminaires once a predetermined minimum period of time from the preceding switch-off operation has expired. As a result, the electronic ballast can establish whether this number is an even number or an odd number and, on the basis of this, the first lamp or the second lamp can be boosted in order to switch on the luminaire more quickly.

BRIEF DESCRIPTION OF THE DRAWINGS

The invention will be explained in more detail below with reference to the drawings, in which.

PREFERRED EMBODIMENT OF THE INVENTION

The luminaire shown in FIGS. 1 to 4 comprises an electronic ballast 10, which may comprise a microprocessor (not shown), and two high-pressure discharge lamps 12*a* and 12*b*. The luminaire according to the invention includes a light switch 14, which is illustrated as being switched on in FIG. 1. In the switched-on state, the electronic ballast 10 drives the two lamps 12*a* and 12*b*, as is illustrated by the arrows, and these two lamps 12*a* and 12*b* are switched on and output light (illustrated schematically). The invention can also be applied to a pair of luminaires comprising physically adjacent luminaires which each comprise one of the lamps 12*a* and 12*b*. However, the common ballast 10 and one common light switch 14 are essential.

Figure 5:
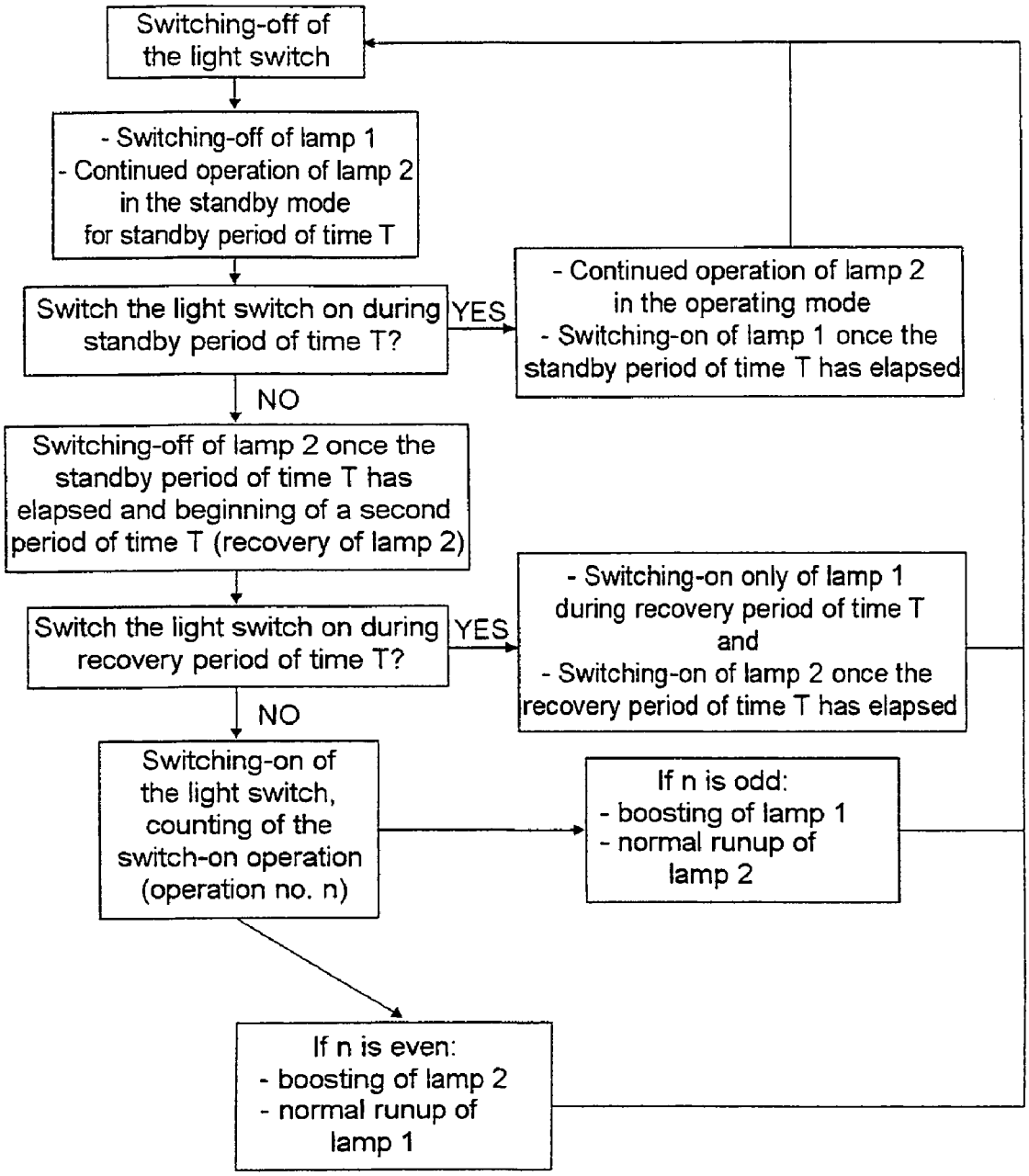

The method according to the invention begins, in accordance with FIG. 5, with the light switch being switched off.

Figure 1:
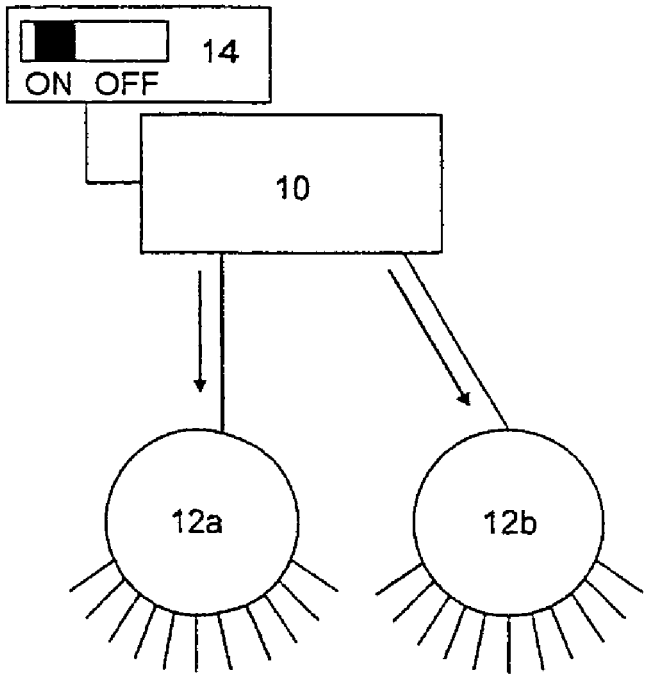
FIG. 1 shows a schematic of the luminaire according to the invention in the switched-on state.
Figure 2:
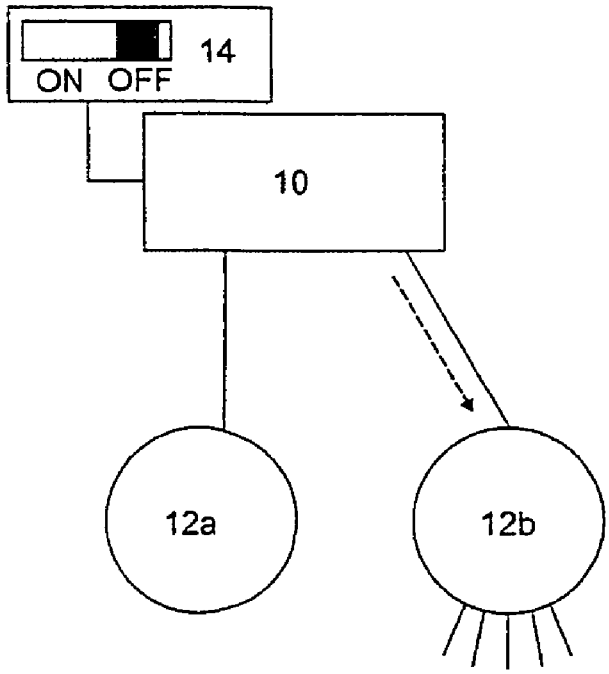
FIG. 2 shows a schematic of the luminaire according to the invention, once it has been switched off, in the standby mode.

Once the light switch has been switched off, the first lamp, in this case the lamp 12*a*, is switched off and the second lamp continues to be operated in the standby mode for a standby period of time T. This is illustrated in FIG. 2, which shows that, despite the fact that the switch 14 is switched off, the electronic ballast 10 still drives the lamp 12*b* (indicated by the dashed arrow), and this lamp 12*b* still outputs light. FIG. 2 illustrates the fact that the lamp 12*b* outputs less light than in the switched-on state, as shown in FIG. 1, i.e. it is dimmed in comparison with this state. The standby mode does not necessarily need to be associated with dimming; it is also possible for the lamp 12*b* to define its normal operating state as the standby mode. The lamp may also be driven in pulsed fashion by the electronic ballast and flicker.

After the step of the lamp 1 being switched off and the lamp 2 continuing to be operated, there is the question as to whether the light switch is switched on during the standby period of time T. If the answer to this question (see FIG. 5) is YES, the lamp 2 continues to be operated in the operating mode, and the lamp 1 is switched on once the standby period of time T has elapsed. This situation is not illustrated in the figures. If the light switch is switched on during the standby period of time, the second lamp is immediately available because it does not need to be restarted. In order to restart the lamp 1, it is necessary to wait for the recovery time for the lamp 1 to elapse, i.e. the standby period of time T. Provision may be made for the lamp 2 to be operated, once the luminaire has been switched on, at a higher power as long as the first lamp is not yet illuminated. Owing to the higher power, the lamp 2 outputs more light and therefore partially compensates the absence of the lamp 1.

If the answer to the question as to whether the light switch 14 is switched on during the standby period of time T is NO, it can be seen in FIG. 5 that the lamp 2 is switched off once the standby period of time T has elapsed and a second period of time T begins which is used for the recovery of lamp 2.

Figure 3:
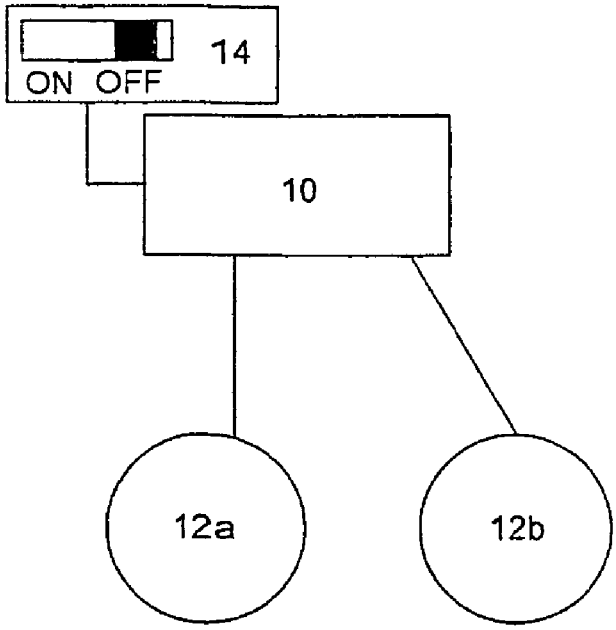
FIG. 3 shows a schematic of the luminaire according to the invention in the switched-off state.

The situation of the switched-off lamp is shown in FIG. 3. The switch 14 is at OFF, and the electronic ballast 10 does not output any control pulses to the lamps 12*a* and 12*b*, which correspondingly output no light. In the situation shown in FIG. 3, there is initially a wait for the second period of time T, i.e. the previously dimmed lamp 12*b* likewise needs to recover in order to be immediately capable of starting. Once this period of time has expired, both lamps are ready to start.

There is therefore the question (see FIG. 5) as to whether the light switch is switched on during the recovery period of time T for the second lamp. If the answer to this question is YES, the first lamp is switched on during the recovery period of time T, and the second lamp is switched on once the recovery period of time T has elapsed.

Figure 4:
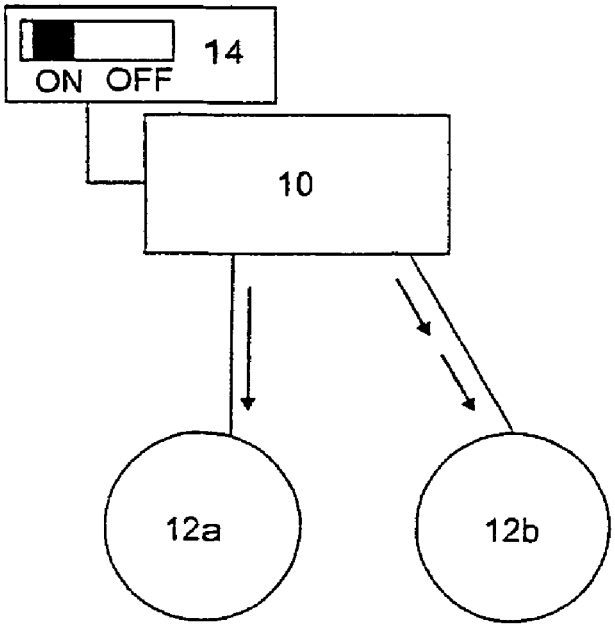
FIG. 4 shows a schematic of the luminaire according to the invention directly after it has been switched on, and FIG. 5 shows the method according to the invention in a schematic chart.

If the light switch is not switched on during the recovery period of time T for the second lamp, at some point the light switch 14 is necessarily switched on once again. This situation is illustrated in FIG. 4. The electronic ballast 10 counts the switch-on operation. If the number of switch-on operations is odd, the first lamp is boosted, and the second lamp is run up normally.

If the number of switch-on operations is even, the situation shown in FIG. 4 results: the second lamp is boosted (illustrated by second drive arrows from the electronic ballast 10 to the second lamp 12*b*), and the first lamp 12*a* is run up normally (illustrated by only one drive arrow).

Once the two lamps 12*a* and 12*b* have been started, the situation shown in FIG. 1 is again produced.

Even if it is illustrated in FIG. 5 that in each case the lamp 1 is switched off when the light switch is switched off, as a deviation from this, provision may also be made for, alternately, first lamp 1 and then lamp 2 to be switched off in this situation.

Owing to the fact that the lamps 12*a* and 12*b* of the luminaire illustrated in FIGS. 1 to 4 are switched off in stepwise fashion and the lamps are possibly switched on again in stepwise fashion, the luminaire according to the invention has four states, namely two on states and two off states, in which case it is only half switched off in one off state and completely switched off in the other off state and only half switched on in one on state and completely switched on in the other on state. The invention is based on the knowledge that one of two luminaires already provides sufficient light for it to be possible for an on state of the luminaire to be defined. On the other hand, an operator therefore only produces the off state in order that the on state does not last any longer. He therefore generally does not desire darkness such that it is of no further consequence if, in the preliminary off state, one of the two lamps (see lamp 12*b* in FIG. 2) is still illuminated in the standby state.

The invention claimed is:

1. A method for operating high-pressure discharge lamps without hotstarting, in which:

two high-pressure discharge lamps are provided in a luminaire or a pair of luminaires comprising physically adjacent luminaires, when the luminaire or the pair of luminaires is switched off, the first lamp is switched off and the second lamp is set to be in a standby state for the period of time for recovery of the first lamp or remains in such a state, in which it is not switched off such that, when the luminaire is switched on again during this period of time, the second lamp assumes the operating state with maximum light output without being started, the second lamp likewise being switched off if the luminaire is not switched on again once the period of time has elapsed.

2. The method as claimed in claim 1, in which the second lamp is operated normally in the standby state.

3. The method as claimed in claim 1, in which the second lamp is dimmed in the standby state such that it outputs less light.

4. The method as claimed in claim 3, in which the second lamp is operated in pulsed fashion in the standby state such that it outputs flickering light.

5. The method as claimed in claim 1, in which the second lamp is operated in pulsed fashion in the standby state such that it outputs flickering light.

6. The method as claimed in claim 1, in which, once the second lamp has been switched off during a period of time for the recovery of the second lamp, initially only the first lamp is started and therefore switched on when the luminaire is switched on again, and the second lamp is also started and therefore switched on only once the period of time for the recovery of the second lamp has elapsed.

7. The method as claimed in claim 6, in which, once the period of time for the recovery of the second lamp has expired without the luminaire or the pair of luminaires being switched on again, both lamps are started and therefore are switched on again when the luminaire or the pair of luminaires is switched on, in each case one of the lamps being boosted.

8. The method as claimed in claim 7, in which when one lamp is boosted, there is alternate operation in each case between the two lamps from one switch-on operation of the luminaire to the next such switch-on operation.

9. The method as claimed in claim 1, in which, when the luminaire is switched on again during the period of time for the recovery of the first lamp, the second lamp is operated above its rated power until the first lamp is started again and has reached its rated luminous flux.

10. The method as claimed in claim 1, in which, when the luminaire or the pair of luminaires is switched off, alternately initially the first or the second lamp is switched off.

11. A luminaire arrangement comprising two high-pressure discharge lamps arranged so that:

when the luminaire arrangement is switched off the first lamp is switched off and the second lamp is arranged so that it is set to be in a standby state either (a) for the period of time for recovery of the first lamp or (b) until such time as the luminaire arrangement is switched on again, wherein the luminaire arrangement is arranged so that the second lamp assumes the operating state with maximum light output without being started, and wherein the second lamp is likewise switched off if the luminaire arrangement is not switched on again once the period of time for recovery of the first lamp has elapsed.

12. A luminaire arrangement as claimed in claim 11, in which the two high-pressure discharge lamps of the luminaire arrangement have a common ballast.

13. A luminaire arrangement as claimed in claim 11, in which the two high-pressure discharge lamps of the luminaire arrangement have a common light switch.

* * * * *